US011183378B2

(12) United States Patent
Wilkins et al.

(10) Patent No.: US 11,183,378 B2
(45) Date of Patent: Nov. 23, 2021

(54) APPARATUS AND METHOD TO BYPASS A SAMPLE CHAMBER IN LASER ASSISTED SPECTROSCOPY

(71) Applicant: Elemental Scientific Lasers, LLC, Omaha, NE (US)

(72) Inventors: Jay N. Wilkins, Belgrade, MT (US); Leif C. Summerfield, Bozeman, MT (US); Shane Hilliard, Bozeman, MT (US); Ciaran J. O'Connor, Bozeman, MT (US)

(73) Assignee: ELEMENTAL SCIENTIFIC LASERS, LLC, Omaha, NE (US)

( * ) Notice: Subject to any disclaimer, the term of this patent is extended or adjusted under 35 U.S.C. 154(b) by 27 days.

(21) Appl. No.: 16/432,350

(22) Filed: Jun. 5, 2019

(65) Prior Publication Data

US 2019/0371590 A1 Dec. 5, 2019

Related U.S. Application Data

(60) Provisional application No. 62/680,654, filed on Jun. 5, 2018.

(51) Int. Cl.
*H01J 49/04* (2006.01)
*H01J 49/00* (2006.01)

(52) U.S. Cl.
CPC ..... *H01J 49/0463* (2013.01); *H01J 49/0031* (2013.01); *H01J 49/0404* (2013.01); *H01J 49/0495* (2013.01)

(58) Field of Classification Search
CPC ..... H01J 49/0463; H01J 49/0031; H01J 49/0404; H01J 49/0495
See application file for complete search history.

(56) References Cited

U.S. PATENT DOCUMENTS

2011/0042564 A1 2/2011 Yasuhide et al.
2011/0240839 A1 10/2011 Hutchinson et al.
2013/0032711 A1* 2/2013 Ishiguro ..... H01J 49/0013 250/288
2013/0280819 A1* 10/2013 Cooks ..... H01J 49/4205 436/173
2013/0320207 A1* 12/2013 Morokuma ..... H01J 49/0404 250/288
2014/0138540 A1* 5/2014 Ouyang ..... H01J 49/10 250/288
2014/0224775 A1 8/2014 Sharp et al.
(Continued)

FOREIGN PATENT DOCUMENTS

KR 20150134373 A 12/2015

OTHER PUBLICATIONS

PCT International Search Report and Written Opinion for Application No. PCT/US2019035570, dated Sep. 25, 2019.
(Continued)

*Primary Examiner* — Sean M Luck
(74) *Attorney, Agent, or Firm* — Kevin E. West; Advent, LLP

(57) ABSTRACT

In a laser assisted spectroscopy system, an apparatus for bypassing the fluid conduit and a method of bypassing the fluid conduit, opening the sample chamber and replacing the sample, closing and purging the sample chamber, and removing the fluid conduit bypass and returning to online status is addressed by the present disclosure.

21 Claims, 6 Drawing Sheets

(56) References Cited

U.S. PATENT DOCUMENTS

| | | | | |
|---|---|---|---|---|
| 2014/0227776 | A1 | 8/2014 | Sharp et al. | |
| 2014/0268134 | A1 | 9/2014 | O'Connor | |
| 2015/0357173 | A1 | 12/2015 | Koeppen et al. | |
| 2016/0049283 | A1 | 2/2016 | Gunther et al. | |
| 2016/0225596 | A1 | 8/2016 | Hayden et al. | |
| 2017/0140912 | A1* | 5/2017 | Ouyang | H01J 49/04 |
| 2017/0299522 | A1 | 10/2017 | Vanhaecke et al. | |

OTHER PUBLICATIONS

Van Malderen, et al., "Development of a fast laser ablation-inductively coupled plasma-mass spectrometry cell for sub-μm scanning of layered materials", Journal of Analytical Atomic Spectrometry, Jan. 2015, pp. 119-125, vol. 30, No. 1.

* cited by examiner

APPARATUS AND METHOD TO BYPASS A SAMPLE CHAMBER IN LASER ASSISTED SPECTROSCOPY

BACKGROUND

Laser ablation techniques use a laser beam to ablate a portion of a sample to produce an ablated sample plume. The resulting ablated sample plume is then passed to a sample analyzer.

Laser-assisted spectroscopy (LAS) systems can be used with laser ablation inductively coupled plasma mass spectroscopy (LA-ICPMS), laser ablation inductively coupled plasma emission spectroscopy (ICP-OES/ICP-AES), and matrix assisted laser desorption ionization time of flight (MALDI-TOF) spectroscopy. Such systems can include a tubular fluid conduit for passing a fluid such as an inert gas therethrough. A central portion of the tubular element may have an aperture (collection orifice) for admitting a sample plume generated by laser ablation upon a sample target. The sample plume is carried by the fluid to a sample analyzer such as a plasma generator and a mass spectrometer. The LAS generally is a system closed to ambient air, except when the sample chamber is opened for sample replacement.

Quick and efficient analysis of multiple samples requires quick and efficient replacement of the samples into the system. During replacement of samples, care must be taken to prevent ambient air from entering the tubular element and flowing to the plasma generator. The disclosure relates to an apparatus and method for conducting LAS where the sample chamber is bypassed from the fluid conduit during sample replacement and sample chamber purge.

DRAWINGS

The detailed description is described with reference to the accompanying figures. The use of the same reference numbers in different instances in the description and the figures may indicate similar or identical items. Various implementations or examples ("examples") of the present disclosure are disclosed in the following detailed description and the accompanying drawings. The drawings are not necessarily to scale. In general, operations of disclosed processes may be performed in an arbitrary order, unless otherwise provided in the claims.

DETAILED DESCRIPTION

Figure 1:
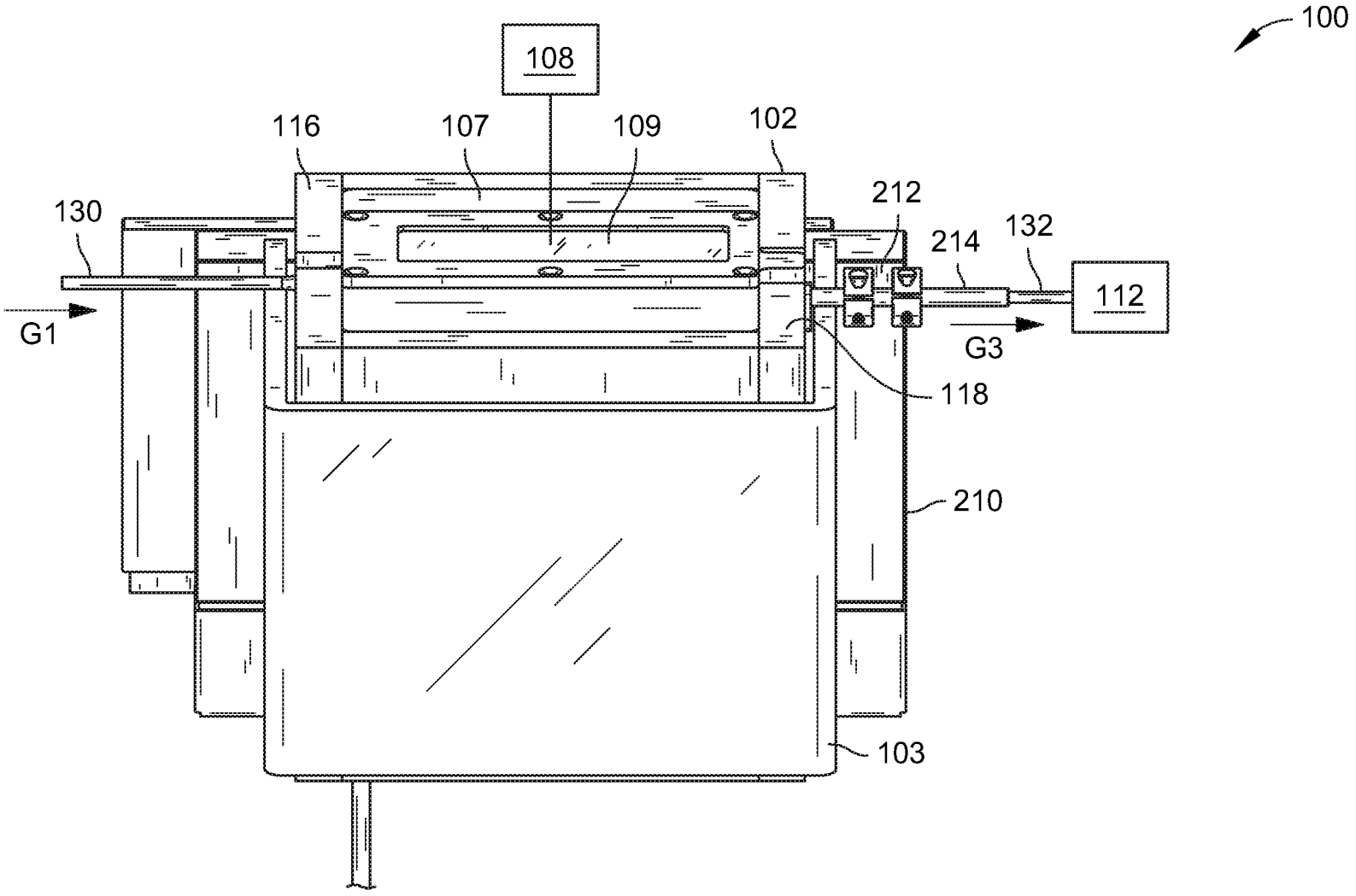
FIG. 1 is a partial schematic illustration of a laser ablation system according to an implementation of the disclosure.

Laser-assisted spectroscopy (LAS) involves directing laser energy at a sample of matter in order to disassociate its constituent parts and make them available to a spectrometer for processing. LAS systems typically apply this laser energy to the sample in a sample chamber while passing a fluid, typically an inert gas, over the sample to capture the disassociated specie and carry them to a spectroscope for processing. Sampling and detecting constituent parts of a sample with mass or optical spectrometry using an inert gas flow may be necessary since, for example, an inductively coupled plasma instrument depends upon a plasma torch to ionize the laser ablated material for subsequent processing. This plasma torch can only operate in an inert atmosphere since ambient air extinguishes the plasma torch. If the plasma torch is extinguished, the system must be restarted and recalibrated, taking time and expertise.

LAS systems typically require opening the sample chamber (or breaking the seal) to remove old sample and insert new sample. While this is happening, it is useful to bypass the sample chamber from the inert fluid conduit to the spectrometer and prevent ambient air from reaching the plasma torch and extinguishing it, among other reasons. For the same reasons, the sample chamber is desirably purged of ambient air prior to reconnection to the fluid conduit to the spectrometer following opening and closing.

An apparatus for bypassing the fluid conduit and a method of bypassing the fluid conduit, opening the sample chamber and replacing the sample, closing and purging the sample chamber, and removing the fluid conduit bypass and returning to online status is addressed by the present disclosure. The fluid conduit may be bypassed by valving the collection orifice.

Overview

The present disclosure illustrates an apparatus and method to allow bypass of the fluid conduit from the sample chamber, sample replacement, and purge of the sample chamber while maintaining linear flow in the fluid conduit to the sample analyzer.

Example Implementations

Example implementations are described herein with reference to the accompanying drawings. Unless otherwise expressly stated, in the drawings the sizes, positions, etc., of components, features, elements, etc., as well as any distances therebetween, are not necessarily to scale, but are exaggerated for clarity. In the drawings, like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

The terminology used herein is for the purpose of describing particular example implementations only and is not intended to be limiting. Unless otherwise defined, all terms (including technical and scientific terms) used herein have the same meaning as commonly understood by one of ordinary skill in the art. As used herein, the singular forms "a," "an" and "the" are intended to include the plural forms as well, unless the context clearly indicates otherwise. It should be recognized that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one node could be termed a "first node" and similarly, another node could be termed a "second node", or vice versa. Unless indicated otherwise, the term "about," "thereabout," "approximately," etc., means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. Spatially relative terms, such as "below," "beneath," "lower," "above," and "upper," and the like, may be used herein for ease of description to describe one element or feature's relationship to another element or feature, as illustrated in the FIG. 1*t* should be recognized that the spatially relative terms are intended to encompass different orientations in addition to the orientation depicted in the FIGS. For example, if an object in the FIGS. is turned over, elements described as "below" or "beneath" other elements or features would then be oriented "above" the other elements or features. Thus, the exemplary term "below" can encompass both an orientation of above and below. An object may be otherwise oriented (e.g., rotated 90 degrees or at other orientations) and the spatially relative descriptors used herein may be interpreted accordingly.

It will be appreciated that many different forms, implementations, and combinations are possible without deviating from the spirit and teachings of this disclosure and so this disclosure should not be construed as limited to the example implementations set forth herein. Rather, these examples and implementations are provided so that this disclosure will be thorough and complete, and will convey the scope of the disclosure to those skilled in the art.

Figure 2:
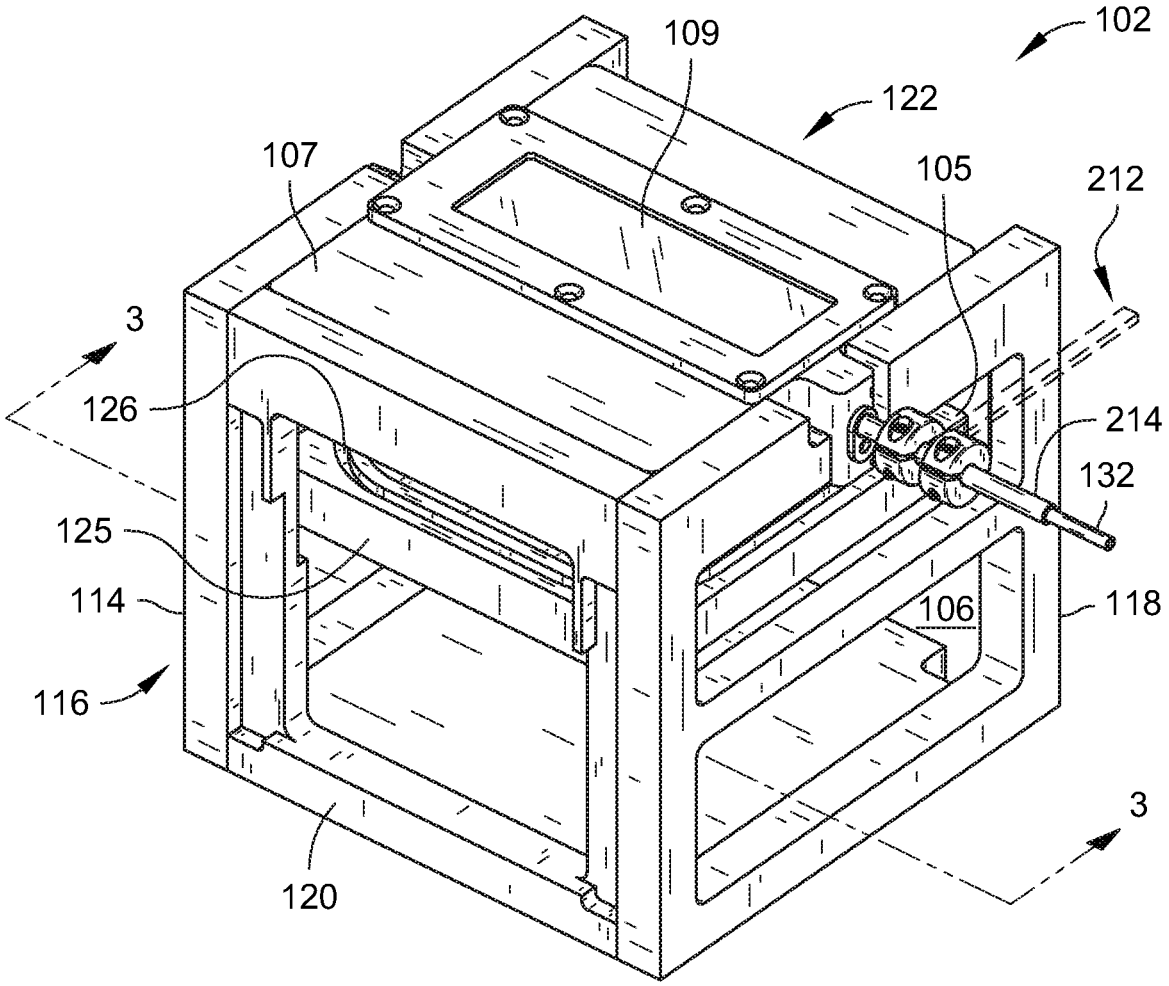
FIG. 2 is a perspective view of a sample chamber of a laser ablation system according to an implementation of the disclosure.
Figure 3:
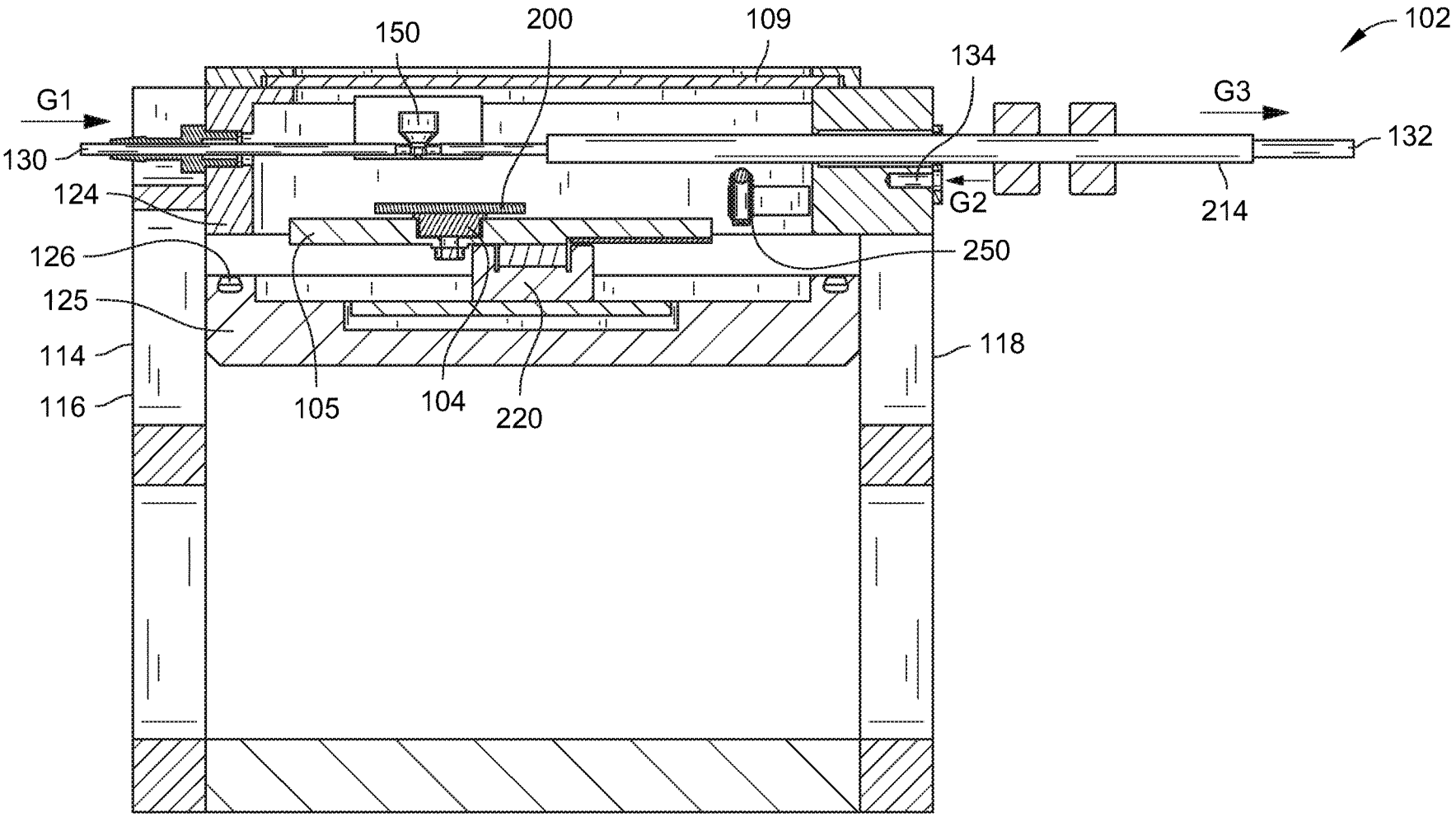
FIG. 3 is a cross-sectional view of a sample chamber and fluid conduit of a laser ablation system of an implementation of the disclosure, taken along the 3-3 line of FIG. 2.

FIGS. 1, 2, and 3 illustrate an LAS system 100 having a sample chamber 102 configured to accommodate a sample platform 105 within an interior 106 thereof. Target sample 200 (shown in FIG. 3) may be supported on sample platform 105 on sample holder 104. A sample generator 108, e.g. a laser, is configured to ablate a portion of the target sample 200 as an ablated sample plume (not shown), which is then carried to the sample analyzer 112 through a fluid conduit (described below). When in operation, sample chamber 102 may be shielded by radiation shield 103.

Sample holder 104 and sample platform 105 are movable within sample chamber 102 to allow line-scanning of the laser on the target sample. Sample platform 105 may also be movable within the sample chamber 102 to allow replacement of the target sample as described below. The sample platform 105 and sample holder 104 may function as described in WO 2018/195425 filed on Apr. 20, 2018 which is incorporated herein in its entirety. Persons skilled in the art will find other methods of opening the sample chamber and replacing the sample which may be used in the present disclosure, which is directed to devices and methods for bypassing the fluid flow conduit from the sample chamber during opening of the sample chamber.

Examples of materials that can be provided as a target sample include, for example, archaeological materials, biological assay substrates and other biological materials, ceramics, geological materials, pharmaceutical agents (e.g., pills), metals, polymers, petrochemical materials, liquids, semiconductors, etc.

Sample generator 108 may be a laser. One or more characteristics of the laser energy generated by sample generator (laser) 108 may be selected or otherwise controlled to impinge a region of the target sample to ablate a portion of the target sample. Characteristics that may be selected or otherwise controlled may, for example, include wavelength (e.g., in a range from about 157 nm to about 11 μm, such as 193 nm, 213 nm, 266 nm, or the like), pulse duration (e.g., in a range from about 100 femtoseconds to about 25 nanoseconds), spot size (e.g., in a range from about 1 μm to about 9 mm, or the like), pulse energy, average power, peak power, temporal profile, etc. The sample generator 108 may also include laser optics (e.g., one or more lenses, beam expanders, collimators, apertures, mirrors, etc.) configured to modify laser light generated by one or more of the lasers.

Sample chamber 102 may include a top wall 107 having a transparent window 109 therein, allowing passage therethrough of the laser energy used for laser ablating. For example, transparent window 109 may be formed of fused silica.

Sample chamber 102 includes a frame 114 which may define a cube and have four faces, sides 116, 118, front 120, and back 122. The sample chamber upper body 124 is fixedly held by the four frame faces 116, 118, 120, 122. Sample chamber 102 also includes a lower movable body 125 which is held by the four frame faces 116, 118, 120, 122 and is configured to move up and down within the faces from the action of a pneumatic piston (not shown). During sample ablation, lower body 125 abuts sample chamber upper body 124 with a sealed connection. An o-ring (not shown) within o-ring channel 126 ensures the seal.

The LAS system 100 includes a sample analyzer 112 which may include a device for plasma generation (e.g., via an inductively coupled plasma (ICP) torch), spark ionization, thermal ionization, atmospheric pressure chemical ionization, fast atom bombardment, glow discharge, and the like or a combination thereof. The sample analyzer further may include a device to analyze the generated plasma. For example, the sample analyzer 112 may be provided as an MS system (e.g., a noble gas MS system, a stable isotope MS system, etc.), an OES system, or the like, or a combination thereof.

Fluid flow through the LAS is accomplished through a fluid conduit. A first fluid conduit conducts fluid from a source outside the system to the sample analyzer 112. This fluid conduit includes lines 130 and 132. G1 enters the system through inlet line 130 and outlet line 132 directs fluid G3 to the sample analyzer 112. As described below, ablated sample plume (not shown) is also carried by line 132 to the sample analyzer 112.

A chamber fluid G2 is introduced into the sample chamber interior 106 through inlet 134. During operation of the system, the chamber is sealed from ambient air and chamber fluid G2 may assist in movement of the sample plume into the fluid conduit 132 to the sample analyzer. After opening of the sample chamber and sample replacement, G2 is used to purge the sample chamber of ambient air. During purging of the sample chamber 102, fluid is delivered through inlet fluid conduit 134 to purge the chamber of any entering ambient air; excess fluid exits via purge gas outlets such as in the bottom of lower chamber body 125 (not shown).

G1 and G2 can be an inert gas such as helium, argon, nitrogen, or the like, or a combination thereof and may be the same or different. G1 and/or G2 may be delivered at a rate between about 500 ml/min to 1000 ml/min. G3 may be a combination of G1, G2, and the sample plume. Lines 130 and 132 may be made of a rigid or flexible material, such as stainless steel or plastic. All attachments of fluid lines to the LAS are sealed to prevent entry of ambient air as well as dust, debris, or other unwanted contaminants from entering the system.

Ablated sample plume is delivered into the first fluid conduit from sample chamber 102 through the sample capture cell 150. Sample capture cell 150, shown in FIG. 3, may be configured for several purposes. For example, sample capture cell 150 may be configured to allow passage of laser energy therethrough; allow fluid passage and connection of fluid lines 130, 132; and receive the ablated sample plume (not shown) from the target sample 200 and transfer it to fluid line 132.

As best shown in FIG. 4, sample capture cell 150 may include a connecting central section 154 where inlet line 130 transitions into outlet line 132. Inlet line 130 and outlet line 132 may join at the connecting central section 150 each at an angle from about 0° to 45°. In other words, lines 130 and 132 may each intersect connecting central section 154 at an angle or substantially horizontally (at an angle of 0°). Lines 130 and 132 may range in diameter from 50 μm up to 4 mm, desirably around 2 mm, and sample capture cell connecting portion 154 may be substantially the same tubular shape and diameter. Central section 154 may have an extension or protrusion 156 in the direction of target sample holder 104 which ends in collection orifice (aperture) 158. Protrusion 156 and collection orifice 158 are configured to allow passage of the laser energy onto target sample 200. Protrusion 156 and collection orifice 158 also are configured for passage of the ablated sample plume into the carrier fluid flow passing through lines 130 and 132. Collection orifice 158 may measure about 0.1 mm to 10 mm in diameter, desirably about 1 mm. Collection orifice 158 is also called a sniffer herein as it is the means through which the ablated sample plume enters the fluid conduit leading to the sample analyzer.

In addition, central section 154 may have a transparent wall or window (not shown) on the side towards laser 108 allowing passage therethrough of the laser energy used for laser ablating. For example, transparent wall or window may be formed of fused silica.

Figure 4A:
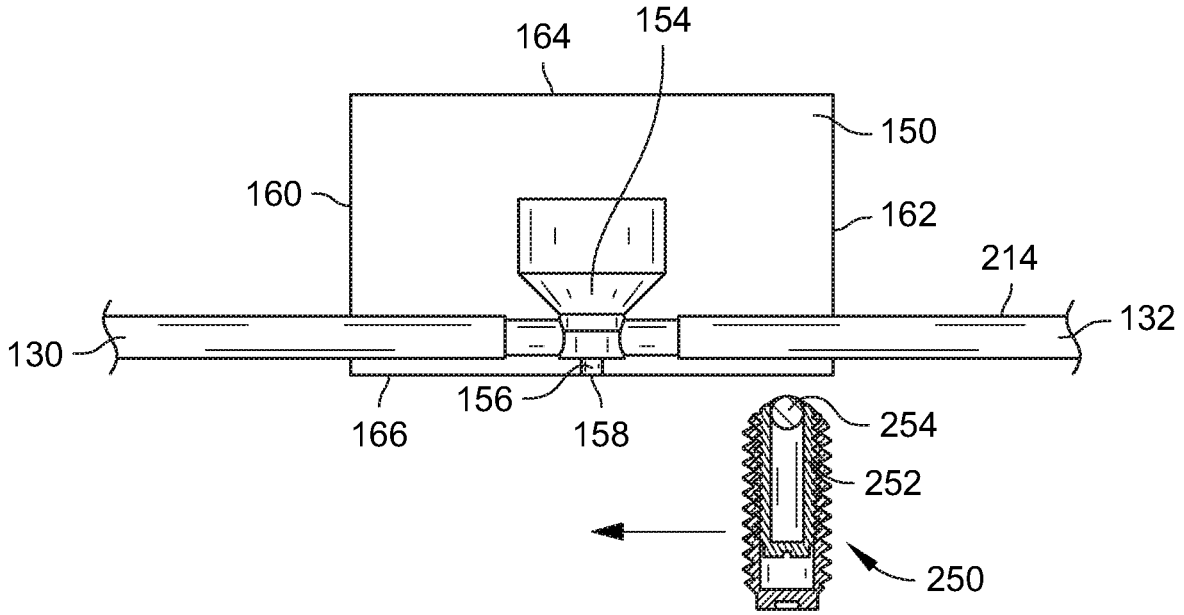
FIG. 4A is a cross-sectional schematic view of a bypass valve of a collection orifice and fluid conduit of a laser ablation system according to an implementation of the disclosure in online mode.

As shown in FIGS. 4A and B, sample capture cell 150 may have side walls 160, 162, front and back walls (not shown), top wall 164 and bottom wall 166. Inlet line 130 may enter through side wall 160 and outlet line 132 may exit sample capture cell through side wall 162. Sample capture cell 150 may be made of metal such as stainless steel or plastic.

As shown in FIG. 1, sample chamber 102 is held on a base 210. An arm 212 (also shown in phantom lines in FIG. 2) fixedly holds rod 214 which is connected to sample capture cell 150. The sample capture cell 150, rod 214, and arm 212 are fixed in position with respect to the base 210 but the sample chamber 100 slides on the rod 214 in the x-axis (from left to right) as shown in the FIGS. This sliding movement means the sample 200 can be moved with respect to the sample capture cell 150 (and with respect to laser energy from sample generator 108).

In addition to movement in the x axis (right to left as shown in the FIGS.), the sample holder 104 can move in the y-axis (in and out of the FIGS.) by virtue of movement of a stage 220.

To obtain an ablated sample plume of the target sample 200, one or more laser pulses are generated and propagated along laser energy path from the laser system 108, through the transmission window 109 of the sample chamber and transmission window of sample capture cell 150 and onto target sample 200 in the sample chamber body 102. Material ablated from the target sample 200 is ejected from the target sample 200 as a plume of particles and/or vapor ejected or otherwise generated from the target sample 200 as a result of the ablation. The sample plume passes through collection orifice 158 and is captured into the outlet line 130 and propelled towards the sample analyzer 112.

When the target sample 200 is inserted in the sample chamber 102 and the sample chamber 102 is in operation, the interior of sample chamber 102 is substantially sealed from ambient air. For example, sealing members such as o-rings are used to seal all fluid line and other connections. As mentioned above, lower sample body 125 is sealed to sample chamber upper body 124 with an o-ring in channel 126.

To replace the target sample 200, lower sample body 125 and sample platform 105 are lowered within the frame 114 of sample chamber 102 so that the target sample 200 can be accessed and replaced. This can be best seen in FIG. 2 where the lower sample body 125 is partially lowered within the frame 114.

LAS 100 can operate similarly to the LAS systems described in U.S. Pat. No. 8,879,064 or US Patent Application No. 2017/0299522, 2014/0268134, or 2014/0227776, the disclosures of which are incorporated herein in their entireties.

Accordingly, during sample ablation operation of the LAS, inert gas G1 is flowing into sample capture cell 150 through inlet line 130. Inert gas G2 may be flowing into sample chamber 102 through inlet 134. As mentioned above, when the sample chamber 102 is opened to replace the target sample, it is desirable to prevent ambient air from entering the fluid conduit, especially outlet line 132 and contacting the sample preparation system, such as a plasma torch. The present disclosure describes a device and method to bypass the sample chamber during sample replacement.

Figure 4B:
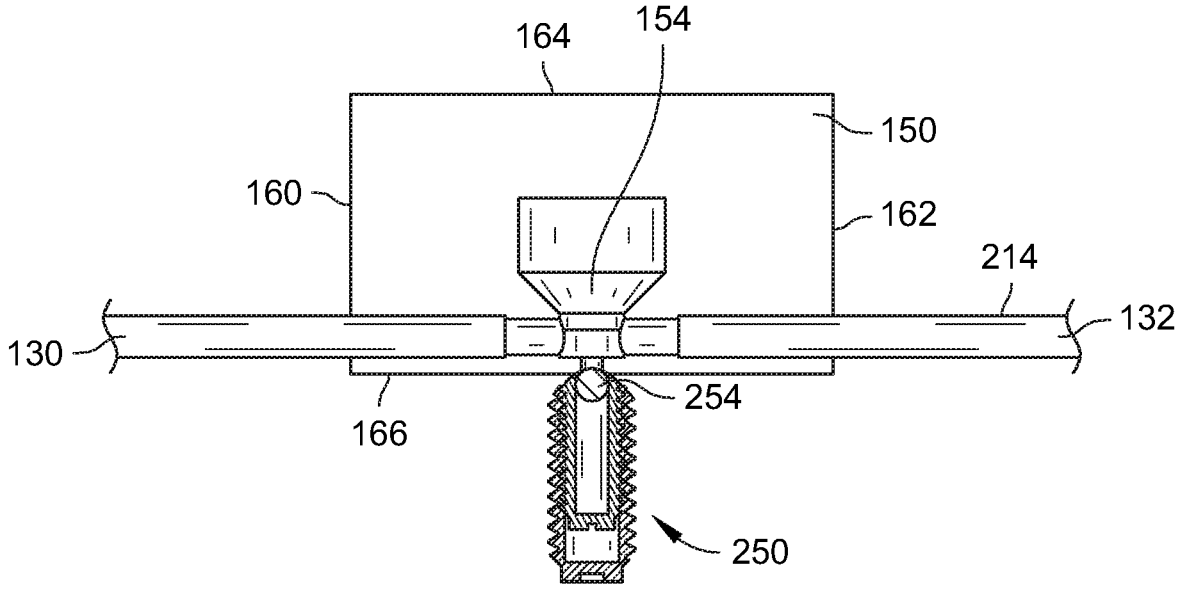
FIG. 4B is a cross-sectional schematic view of a bypass valve of a collection orifice and fluid conduit of a laser ablation system according to an implementation of the disclosure in bypass mode.

The presently described LAS system employs a bypass valve which blocks collection orifice 158 during opening of the sample chamber 102, replacement of the target sample, and purging of the sample chamber 102. As shown in FIGS. 4A and 4B, valve cover 250 may include a pin 252 having a ball tip 254 which is configured to cover collection orifice 158. FIG. 4A illustrates the valve cover 250 during online mode and FIG. 4B illustrates the valve cover 250 in bypass mode. Ball tip 254 blocks the collection orifice 158 during bypass mode. During bypass mode, sample chamber 102 may be opened and the target sample replaced. Still during bypass mode, sample chamber 102 is resealed, and G2 is applied through inlet 134 to purge ambient air from sample chamber 102. In a variation, pin 252 may have a compressible surface which compresses when in contact with collection orifice 158 so as to seal collection orifice 158

In one implementation, such as that shown in FIGS. 3, 4A, and 4B, valve cover 250 is fixedly attached to some part of the sample chamber and as lower sample body 125 and sample platform 105 are moved for target sample replacement, the valve cover 250 correspondingly moves to cover collection orifice 158. This movement of the valve cover 250 can be coordinated to movement of the sample platform 105 and sample holder 104 or can be independently controlled.

As shown in FIG. 3, valve cover 250 is fixedly attached to sample chamber upper body 124 so that valve cover 250 moves in relation to sample capture cell 150 as sample chamber 102 and sample platform 105 are moved in the x-axis. Valve cover 250 is configured to block collection orifice 158 prior to sample platform 105 being lowered for sample replacement. In other words, valve cover 250 is configured to block collection orifice 158 prior to lowering sample platform 105 and breaking the seal provided by o-ring between lower body 125 and sample upper body 124 and prior to sample chamber 102 exposure to ambient air.

Figure 5A:
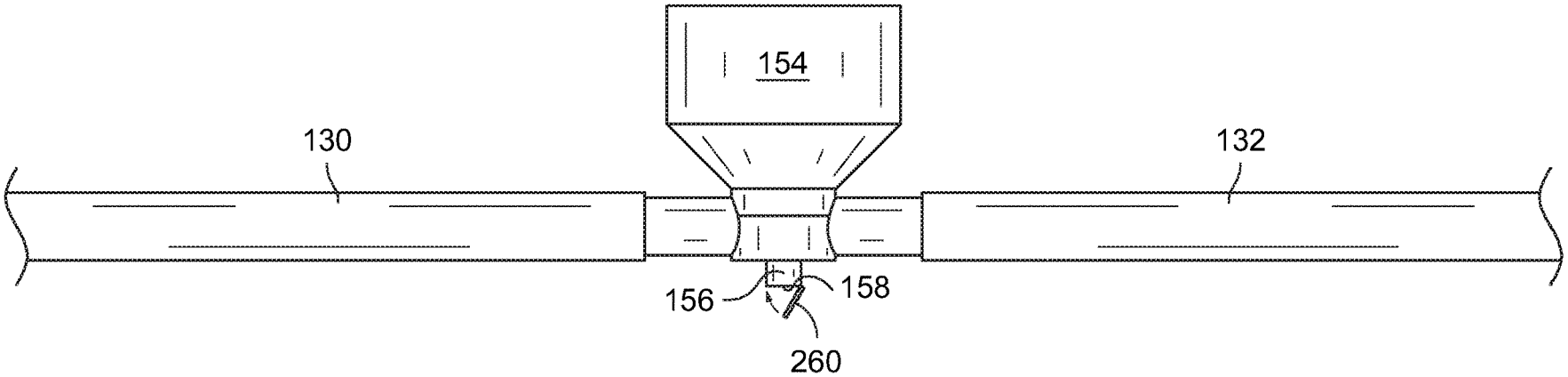
FIG. 5A is a view of another implementation of a collection orifice and fluid conduit bypass valve in online mode and FIG. 5B illustrates the bypass valve in bypass mode.
Figure 5B:
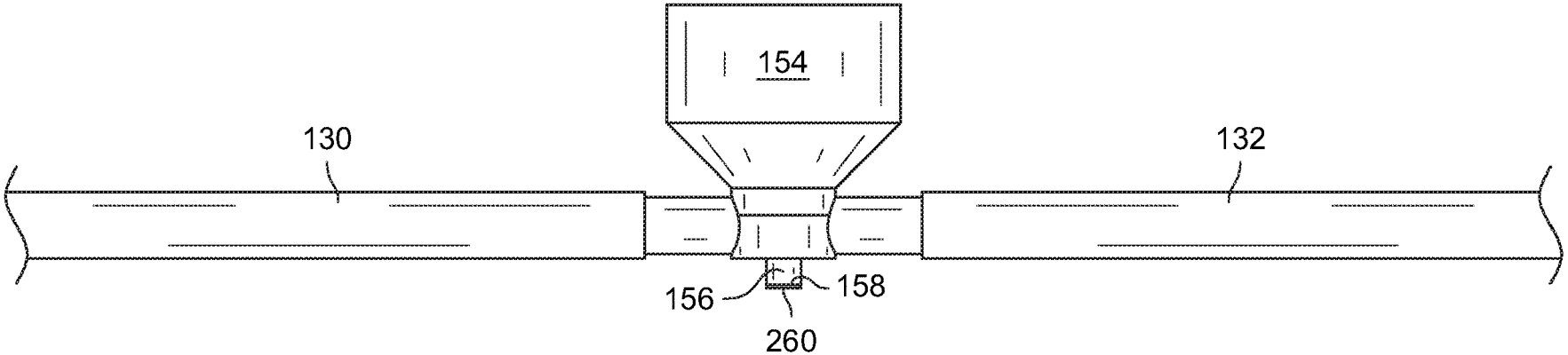

In another implementation, shown in FIGS. 5A and 5B, the bypass valve may be a flap 260 which is attached to collection orifice 158. Closure of flap 260 could be, for example, activated with a solenoid.

In another implementation the bypass valve may be a compressible surface instead of a flap. The compressible surface functions similarly as the flap, to temporarily seal the collection orifice.

Other implementations rely on movement of the sample capture cell 150 and the collection orifice 158 instead of movement of the bypass valve as shown in FIGS. 4A and 4B. Temporary sealing of the orifice may be achieved through a combination of movements that effect the bypass function; the sample moves out of the way, the sample capture cell moves out of the way, the bypass valve is moved under the collection orifice, then the sample capture cell and collection orifice is moved down to affect the seal.

The example implementations are only examples of ways in which collection orifice 158 could be temporarily sealed and the LAS system placed in bypass mode. In addition, the device and method may be used with other LAS configurations and is not limited to the tube cell configuration disclosed herein.

Figure 6:
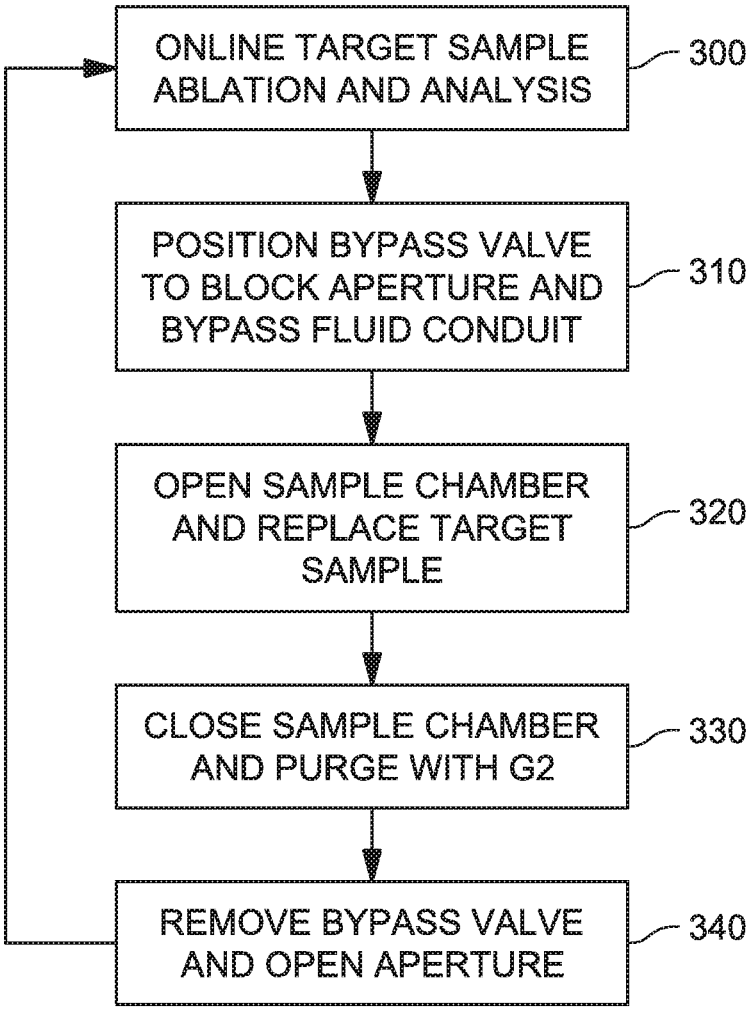
FIG. 6 is a flow chart illustrating operation of the online-bypass-purge system of an implementation of the disclosure.

FIG. 6 is a flow chart illustrating the steps of the method. Block 300 illustrates online operation of sample ablation and analysis, when the sample chamber 102 is sealed and closed to ambient air. Sample generator 108 is active and impinges on target sample 200 to generate sample plumes. G1 flows through inlet line 130 and sample plumes are transferred to sample analyzer 112 via outlet line 132. G2 may be flowing into the sample chamber 102 through chamber fluid inlet 134 to assist in movement of sample plumes into sample capture cell 150. Sample ablation and analysis continues until the target sample is sufficiently sampled.

When it is desired to replace the target sample 200, the bypass valve is positioned to block collection orifice 158 and bypass fluid conduit (Block 310). Accordingly, ambient air or other contaminants that may enter sample chamber 102 may not enter sample capture cell 150 and the fluid conduit. See FIG. 4B and FIG. 5B (or as otherwise enabled).

The target sample is replaced (Block 320) as described above, such as by lowering sample platform 105. After sample replacement, lower chamber body 125 is raised until the seal between it and chamber upper body 124 is restored and the sample chamber 102 is purged (Block 330). Outlets in lower chamber body 125 are opened, if not already open, and G2 is used to purge ambient air from sample chamber 102.

After ambient air is purged, bypass valve is removed from collection orifice 158 so that sample chamber 102 is fluidically connected with sample capture cell 150 and outlet 132 (Block 340). Target sample ablation and analysis may resume.

CONCLUSION

Although the technology has been described with reference to the implementations illustrated in the attached drawing figures, equivalents may be employed, and substitutions made herein without departing from the scope of the technology as recited in the claims. Components illustrated and described herein are merely examples of a device and components that may be used to implement the implementations of the present invention and may be replaced with other devices and components without departing from the scope of the disclosure. All publications, patents, and patent applications cited herein are hereby incorporated by reference in their entirety.

What is claimed is:

1. A laser assisted spectroscopy system comprising a sample chamber configured to contain a target sample, a sample analyzer, and a fluid conduit to allow transfer of a portion of the target sample from the sample chamber to the sample analyzer, and further comprising a collection orifice in the fluid conduit configured to allow passage of a portion of the target sample from the sample chamber into the fluid conduit;

wherein the collection orifice comprises an aperture in a side of the fluid conduit fluidically connecting the fluid conduit with the sample chamber; and wherein the system further comprises a bypass valve configured to seal the collection orifice and block flow from the sample chamber to the fluid conduit.

2. The system of claim 1, further comprising a laser, wherein the laser is configured to contact and ablate the target sample and the portion of the target sample is a sample plume ablated from the target sample.

3. The system of claim 2 wherein the collection orifice allows passage of ablated sample plume into the tubular fluid conduit.

4. The system of claim 2, wherein the sample analyzer comprises a plasma generator and a mass spectrometer.

5. The system of claim 4, wherein the sample chamber is configured to be sealed from ambient air during laser assisted spectroscopy and open to ambient air during target sample replacement.

6. The system of claim 5, wherein the bypass valve is configured to seal the collection orifice when the sample chamber is open to ambient air.

7. The system of claim 2, wherein the system further includes a sample capture cell fluidically connected to the fluid conduit and configured to capture the sample plume and transfer it to the fluid conduit.

8. The system of claim 7, wherein the collection orifice is on the sample capture cell.

9. The system of claim 8, wherein the bypass valve is a ball valve which covers the collection orifice.

10. The system of claim 5 wherein the bypass valve is configured to close the collection orifice as the sample chamber is opened to replace the target sample.

11. The system of claim 8 wherein the bypass valve is a flap valve.

12. A method for replacing target sample in a laser assisted spectroscopy system comprising the steps:

providing a laser assisted spectroscopy system comprising a laser configured to ablate a sample from the target sample, a sample chamber to contain the target sample, a sample analyzer, and a fluid conduit configured to transfer the sample from the sample chamber to the sample analyzer, and a collection orifice comprising an aperture in a side of the fluid conduit, the aperture fluidically connecting the fluid conduit with the sample chamber and configured to allow movement of the ablated sample from the sample chamber to the fluid conduit;

ablating a sample from a target sample with a laser and transferring the sample to the sample analyzer through the fluid conduit;

closing the collection orifice;

opening the sample chamber to replace the target sample;

closing the sample chamber;

purging the sample chamber of ambient air;

opening the collection orifice; and resuming sample ablation and analysis.

13. The method of claim 12 wherein the collection orifice is closed using a bypass valve.

14. The method of claim 13 wherein the target sample is carried on a sample platform and the sample platform is moved within the sample chamber to replace the target sample.

15. The method of claim 14 wherein the sample platform movement is coordinated with deployment of the bypass valve to seal the collection orifice.

16. The method of claim 13, wherein the bypass valve is a ball valve which covers the collection orifice.

17. The method of claim 13, wherein the bypass valve is a flap valve which covers the collection orifice.

18. A device for bypassing a sample chamber of a laser assisted spectroscopy system during opening of the sample chamber for sample replacement, wherein the laser assisted spectroscopy system comprises:

a laser configured to ablate a sample from a target sample, a sample chamber to contain the target sample, a sample analyzer, a fluid conduit configured to transfer the sample from the sample chamber to the sample analyzer, and a collection orifice in a side of the fluid conduit, the collection orifice fluidically connecting the fluid conduit with the sample chamber;

and wherein the device comprises a bypass valve to cover the collection orifice.

19. The device of claim 18, wherein the bypass valve is a ball valve.

20. The device of claim 18, wherein the bypass valve is a flap valve.

21. The device of claim 18, wherein the closing of the collection orifice by the bypass valve is coordinated with opening of the sample chamber to replace the target sample.

* * * * *